US007487707B2

(12) United States Patent
Pfaff et al.

(10) Patent No.: US 7,487,707 B2
(45) Date of Patent: Feb. 10, 2009

(54) HYDRAULIC VALVE ASSEMBLY WITH A PRESSURE COMPENSATED DIRECTIONAL SPOOL VALVE AND A REGENERATION SHUNT VALVE

(75) Inventors: Joseph L. Pfaff, Wauwatosa, WI (US); Dwight B. Stephenson, Oconomowoc, WI (US)

(73) Assignee: Husco International, Inc., Waukesha, WI (US)

( * ) Notice: Subject to any disclaimer, the term of this patent is extended or adjusted under 35 U.S.C. 154(b) by 246 days.

(21) Appl. No.: 11/535,505

(22) Filed: Sep. 27, 2006

(65) Prior Publication Data

US 2008/0072749 A1 Mar. 27, 2008

(51) Int. Cl.
*F15B 11/024* (2006.01)
*E02F 9/22* (2006.01)

(52) U.S. Cl. ..... 91/437; 91/445

(58) Field of Classification Search ..... 91/436, 91/437, 445, 446
See application file for complete search history.

(56) References Cited

U.S. PATENT DOCUMENTS

| | | | | |
|---|---|---|---|---|
| 4,569,273 | A | 2/1986 | Anderson et al. | |
| 4,693,272 | A | 9/1987 | Wilke | |
| 4,953,723 | A * | 9/1990 | Saotome et al. | 91/437 |
| 5,007,544 | A * | 4/1991 | Saotome et al. | 91/437 |
| 5,220,862 | A | 6/1993 | Schexnayder | |
| 5,579,642 | A | 12/1996 | Wilke et al. | |
| 5,715,865 | A * | 2/1998 | Wilke | 91/518 |
| 5,791,142 | A | 8/1998 | Layne et al. | |
| 5,826,486 | A * | 10/1998 | Shimada | 91/436 |
| 6,637,461 | B2 | 10/2003 | Post | |
| 6,745,992 | B2 | 6/2004 | Yang et al. | |
| 6,761,027 | B2 * | 7/2004 | A'Hearn et al. | 91/436 |
| 6,877,417 | B2 | 4/2005 | Shimada | |
| 2005/0072954 | A1 | 4/2005 | Nielsen | |

FOREIGN PATENT DOCUMENTS

| | | |
|---|---|---|
| EP | 0 809 737 B1 | 6/1999 |
| JP | 2001027201 | 1/2001 |
| JP | 2001027203 | 1/2001 |

* cited by examiner

*Primary Examiner*—Thomas E Lazo
(74) *Attorney, Agent, or Firm*—Quarles & Brady LLP

(57) ABSTRACT

A hydraulic circuit controls flow of fluid between first and second ports of a hydraulic actuator, such as a cylinder/piston arrangement and each of a supply conduit and a tank return conduit. The hydraulic circuit operates in standard powered operating modes as well as powered and unpowered regeneration modes. In a powered operating mode, a conventional pressure compensated spool valve determines the velocity of the hydraulic actuator. A workport blocking valve connects one workport of the spool valve to the first port and the other workport is connected to the second port. A regeneration shunt valve is directly connected between the first and second ports of the hydraulic actuator. In a regeneration operating mode or a mix of powered and regeneration modes, a combination of the spool valve, the workport blocking valve, and the regeneration shunt valve determines the velocity of the hydraulic actuator.

27 Claims, 3 Drawing Sheets

| FIG. 1A | FIG. 1B |
|---|---|

HYDRAULIC VALVE ASSEMBLY WITH A PRESSURE COMPENSATED DIRECTIONAL SPOOL VALVE AND A REGENERATION SHUNT VALVE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hydraulic systems that operate actuators, such as cylinder/piston arrangements, and more particularly to hydraulic systems that operate actuators in powered and regenerative modes.

2. Description of the Related Art

A wide variety of machines are operated by a hydraulic system with a plurality of hydraulic actuators, such as cylinder connected one component of the machine and a piston coupled by a rod to another component. The piston divides the interior of the cylinder into two internal chambers and alternate application of hydraulic fluid under pressure to each chamber moves the piston in opposite directions, thereby moving the two components with respect to each other.

In a common hydraulic system, flow of hydraulic fluid to the cylinder was controlled by a manually operated valve in which the human operator moved a lever that was mechanically connected to a spool within a bore of the valve, as shown in U.S. Pat. No. 5,579,643. Movement of that lever placed the spool into various positions with respect to cavities in the bore that communicated with a supply conduit from a pump, return conduit to a fluid tank, and conduits to the chambers of the associated cylinder. Moving the spool in one direction controlled flow of pressurized hydraulic fluid from the pump to one cylinder chamber and allowed fluid in the other chamber to flow to the tank. This drove the piston and the rod connected thereto in one direction. Moving the spool in the opposite direction reversed the fluid flow with respect to the cylinder chambers producing motion in the opposite direction. Varying the amount that the spool was moved in the appropriate direction changed the size of a metering orifice and thus the rate at which fluid flows to the associated cylinder chamber, thereby driving the piston at proportionally different speeds. A pressure compensation mechanism often was incorporated into the spool valve assembly to provide a substantially constant pressure drop across the metering orifice.

There is a trend away from manually operated hydraulic valves toward electrically controlled solenoid valves. U.S. Pat. No. 6,637,461 describes a spool valve that is pilot operated by a pair of electrohydraulic valves to control bidirectional motion of the valve spool.

With both manually and electrically operated devices, the spool valve was built into a separate body, commonly referred to as a valve section, and the valve sections for the plurality of machine functions were bolted side by side to form a valve assembly at the operator workstation of the machine. Each valve section had workports for connecting to the chambers of the respective cylinder. Each valve section also had passages there through for the supply conduit, the tank return conduit, and a load sense circuit, wherein those passages aligned with similar passages in adjacent valve sections to convey fluid through the entire valve assembly. End sections of the valve assembly had ports to connect the supply and tank conduits as well as apertures in which pressure relief valves were mounted.

An alternative to a spool valve comprised a Wheatstone bridge arrangement of four proportional electrohydraulic valves with each one connected between two different corners of a square. Two opposing corners were connected to the workports for the two cylinder chambers. One remaining corner of the bridge was coupled to the supply conduit and the last corner was connected to the tank return conduit. During powered extension and retraction modes of operating the hydraulic cylinder, two valves on opposite sides of the bridge were opened so that fluid from the supply conduit flowed into one cylinder chamber and all the fluid exiting the other cylinder chamber flowed to the tank return conduit.

In an overriding load condition, the external load or other force acting on the machine causes extension or retraction of the hydraulic actuator without requiring significant pressure from the supply conduit. That force drove fluid out of one cylinder chamber, while expansion of the other chamber drew fluid from the supply conduit. During this condition, fluid exited the cylinder under relatively high pressure, thereby containing energy that was lost when the fluid was released into the tank.

The Wheatstone bridge arrangement had the advantage over a spool valve of enabling operation in a regeneration mode in which the energy of that exhausting fluid was recycled, instead of being released unused into the tank. In a self regeneration mode, the two adjacent valves connected to either the supply conduit corner of the bridge of the tank return conduit corner were opened while the other valves remained closed. Thus fluid exhausting from one cylinder chamber is routed by the two of the proportional electrohydraulic valves to the other cylinder chamber that is expanding. As a result, the fluid exiting the contracting cylinder chamber flowed into and was used to fill the expanding chamber, thereby reducing or eliminating the quantity of fluid required from the supply conduit. This required that two proportional electrohydraulic valves had to be accurately controlled to properly meter the regeneration flow. Thus, the electric currents applied to open both valves to precise and consistent positions. In addition, the regeneration flow encountered an energy loss in each of the two valves. One attempt at reducing magnitude of that energy loss involved connecting a fifth electrohydraulic valve directly between the two workports of the valve bridge. Nevertheless, energy losses in the hoses between the valve assembly and the cylinder still affected the efficiency of the regeneration mode.

It is desirable to provide a low energy loss regeneration mode on a hydraulic system that employs spool valves at the operator workstation. This enables an existing machine design to be updated with a regeneration mode of operation.

SUMMARY OF THE INVENTION

A hydraulic circuit is provided to control flow of fluid between a first port and a second port of a hydraulic actuator and each of a supply conduit conveying pressurized fluid and a tank return conduit. That hydraulic circuit comprises a spool valve with an inlet connected to the supply line, an outlet connected to the tank return line, a first workport and a second workport. The spool valve selectively directs fluid from the inlet to one of the first and second workports and directs fluid from another of the first and second workports to the outlet.

A workport blocking valve connects the first workport to the first port of the hydraulic actuator. A regeneration shunt valve connects to the hydraulic actuator and through which fluid flows between the first port and the second port.

In one embodiment of the hydraulic circuit, the workport blocking valve and the regeneration shunt valve are located remotely from the spool valve and proximate to the hydraulic actuator. In another embodiment, the regeneration shunt valve is located remotely from the spool valve and proximate to the hydraulic actuator, while the workport blocking valve is proximate to the spool valve.

In a preferred embodiment, the hydraulic circuit includes a pressure compensation valve connected to the spool valve and maintaining a substantially constant pressure drop between the inlet and a selected one of the first and second workports. In one version of this embodiment, a load sense circuit is connected to the spool valve to provide a signal indicating a pressure level desired in the supply line to operate the hydraulic actuator. The load sense circuit connected to operably control the pressure compensation valve.

DETAILED DESCRIPTION OF THE INVENTION

Figures 1, 2:
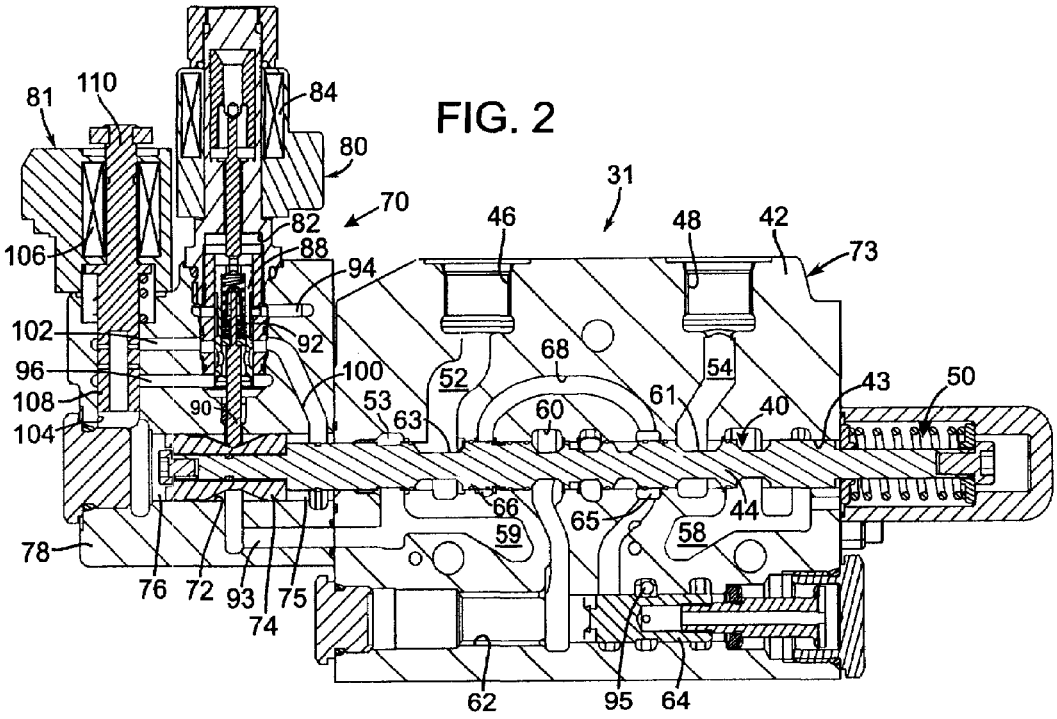
FIG. 1, consisting of sub
FIG. 2 is a cross section through a solenoid operated spool valve used in the hydraulic system.
Figure 1A:
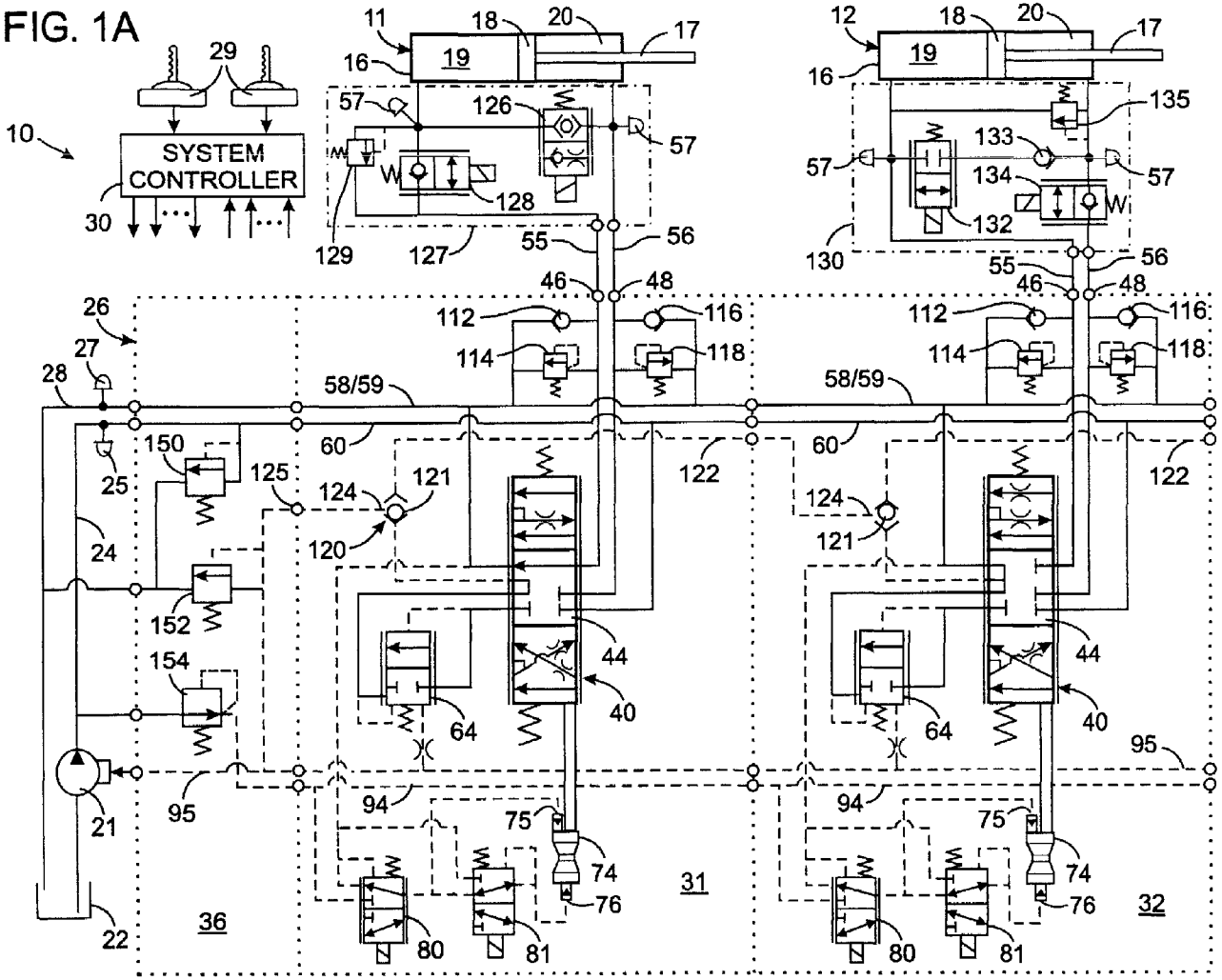
-FIGS. 1A and 1B, is a schematic diagram of a hydraulic system that incorporates the present invention.
Figure 1B:
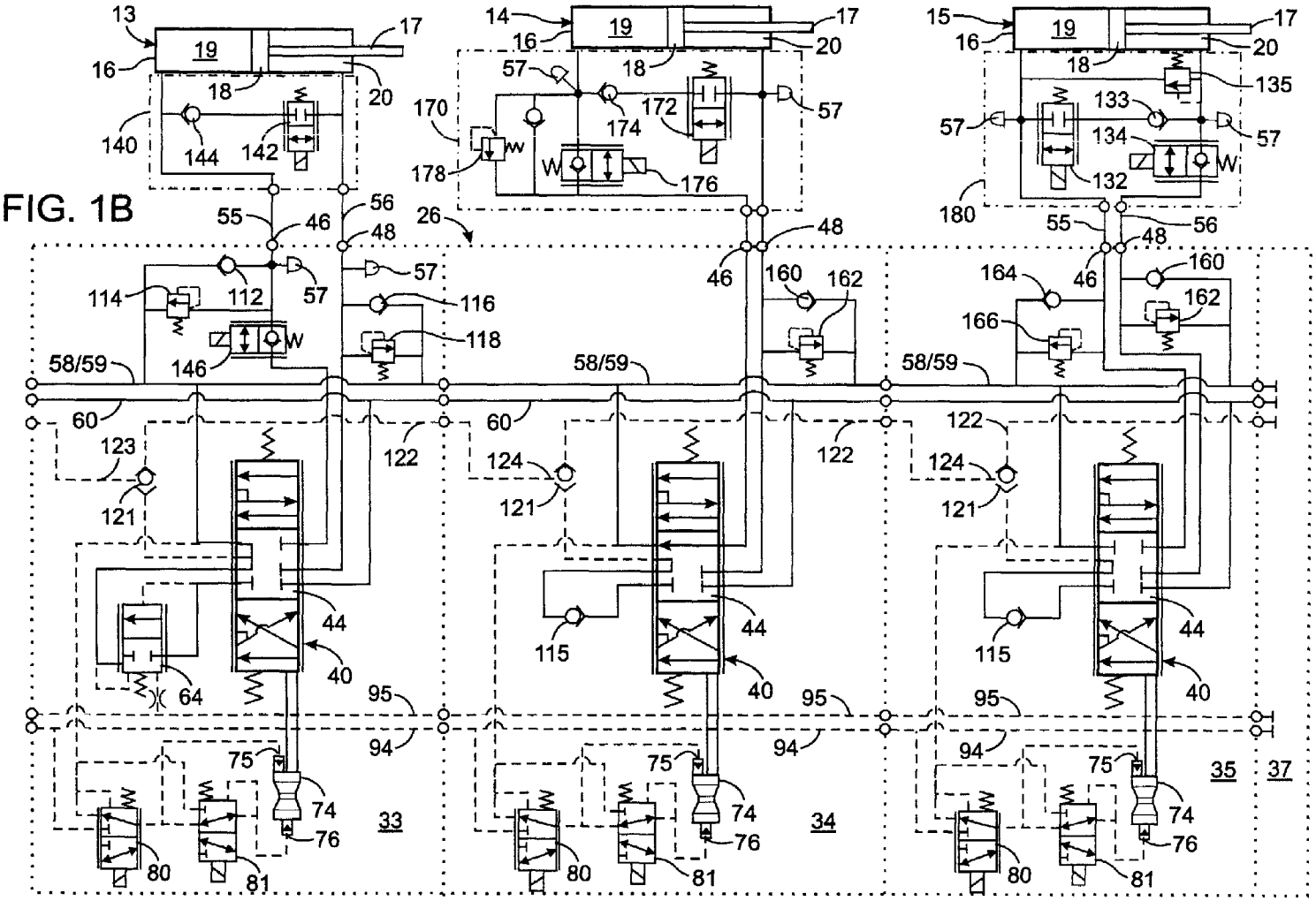

With initial reference to FIGS. 1A and 1B, a hydraulic system 10 on a machine controls operation of five hydraulic actuators 11, 12, 13, 14, and 15 such as cylinder/piston assemblies. Each hydraulic actuator 11-15 comprises a hydraulic cylinder 16 with a movable piston 18 to which a rod 17 is connected. The piston 18 defines a head chamber 19 and a rod chamber 20 within the cylinder, with first and second ports provided for hydraulic connection respectively to those chambers. It should be understood that the present invention can be used with other types of hydraulic actuators, such as a rotating motor for example.

The hydraulic system 10 also includes a variable displacement pump 21 which draws fluid from a tank 22 and furnishes that fluid under pressure into a supply conduit 24. The supply conduit is connected to a control valve assembly 26 that controls the flow of fluid to and from the hydraulic actuators 11-15. The fluid returning from the hydraulic actuators flows through a tank return conduit 28 back into the tank 22. Sensors 23 and 27 measure pressure in the supply conduit 24 and the tank return conduit 28, respectively.

The control valve assembly 26 is operated by a system controller 30, which is a conventional microcomputer-based device that executes a control program. The system controller 30 receives signals from operator input devices, such as joysticks 29, which are manipulated by the machine operator to indicate desired motion of components on the machine. The control program responds to signals by producing electrical currents to open valves within the control valve assembly 26 and apply hydraulic fluid to the hydraulic actuator 11-15 attached to the respective machine component.

The control valve assembly 26 comprises five valve sections 31, 32, 33, 34, and 35 connected side-by-side and sandwiched between first and second end sections 36 and 37. Each control valve section 31-35 has the same basic structure as illustrated for the first control valve section 31 in FIG. 2, however the third, fourth and fifth control valve sections 33, 34 and 35 differ slightly, as will be described. The first control valve section 31 comprises a spool valve 40, which is pilot operated by two electrohydraulic valves 80 and 81. That control valve assembly may be similar to the one described in U.S. Pat. No. 6,637,461, the description of which is incorporated by reference herein, however the present invention can be used with other types of spool valves. The spool valve 40 is formed in a valve block 42 having a primary bore 43 into which fluid passages and ports open. A valve spool 44 reciprocates longitudinally within the primary bore 43 to control the flow of hydraulic fluid to and from a pair of workports 46 and 48. A dual action spring assembly 50 is connected to a first end of the valve spool 44 to return the spool to the illustrated centered closed position in the primary bore 43. The valve spool 44 has a plurality of axially spaced circumferential grooves located between lands, which cooperate with the primary bore 43 to control the flow of hydraulic fluid between different cavities and passage openings in that bore, as will be described.

The first and second workports 46 and 48 are respectively connected by first and second workport passages 52 and 54 to cavities extending around the primary bore 43. With reference to FIG. 1, the workports 46 and 48 are connected by hoses 55 and 56 to the associated first hydraulic actuator 11. Specifically, the first workport 46 is connected to the head chamber 19 of the cylinder 16 and the second workport 48 is connected to the cylinder's rod chamber 20.

The valve block 42 has a plurality of common passages extending there through perpendicular to the plane of the cross-section of FIG. 2 and coupled to identical common passages in the adjacent sections 32-35. A pair of such passages 58 and 59 open into different cavities extending around the primary bore 43 and are connected by the tank return conduit 28 (FIG. 1) to the tank 22 of the hydraulic system. The valve block 42 also has a supply passage 60 that opens into the primary bore 43 and is connected by the supply conduit 24 to the output of the pump 21. The supply passage 60 communicates with another bore 62 in the valve block 42 which contains a conventional pressure compensation valve 64. The pressure compensation valve 64 controls the flow of hydraulic fluid from the supply passage 60 to a pair of supply path cavities 65 and 66 around the primary bore 43 which are connected by a bridge passage 68. This pressure compensating mechanism is described in U.S. Pat. No. 4,693,272, alternatively the pressure compensating mechanism described in U.S. Pat. No. 5,579,642 may be used.

FIG. 2 illustrates the valve spool 44 in the neutral, or centered, position at which fluid is blocked from flowing into or out of the workports 46 and 48. Movement of the valve spool 44 to the right in the drawing initially opens one path between the second workport 48 and tank passage 58 via a first spool notch 61. Further rightward movement of the valve spool 44, opens a metering orifice between the first workport passage 52 and supply path cavity 66 at one end of the bridge passage 68, thereby providing another path between the supply passage 60 and the first workport 46 via the pressure compensation valve 64, supply path cavity 65, the bridge passage 68, and a second spool notch 63. Note that from the centered position the first spool notch 61 opens into the tank passage 58 before the second spool notch 63 opens into the bridge passage 68. Thus fluid drains from the second workport 48 to the tank 22 before pressurized hydraulic fluid from the pump 21 is applied to the first workport 46. The significance of this arrangement with respect to operation of the hydraulic actuator will be described subsequently.

Movement of the valve spool 44 to the left in FIG. 2 initially connects the first workport 46 to cavity 53 of the tank return passage 59 via the second spool notch 63. Continued motion in this direction opens another metering orifice between the supply passage 60 and the second workport 48 in a path through the pressure compensation valve 64, supply path cavity 65, and the first spool notch 61. Such leftward motion from the centered position causes the second spool notch 63 to open into the tank return passage 59 before the first spool notch 61 opens into the supply path cavity 65. As a result fluid drains from the first workport 46 to the tank 22 before pressurized hydraulic fluid from the pump 21 is applied to the second workport 48.

The movement of the valve spool 44 is produced by a force feedback actuator 70 located at the opposite end of the valve spool from the spring assembly 50. The force feedback actuator 70 has an end block 78 attached to one side of the valve block 42 so thaw a piston bore 72 in the end block is aligned with the primary bore 43. The piston bore 72 contains a valve drive piston 74 that is attached to the second end of the valve spool 44. Alternatively the valve spool 44 and the valve drive piston 74 may be formed as a single piece. In either construction, the valve drive piston 74 and the valve spool 44 move reciprocally as a common unit. The valve drive piston 74 has a generally hourglass shape with frustoconical tapered end sections which meet at a central depression there between. First and second piston control chambers 75 and 76 are defined within the piston bore 72 on opposite sides of the valve drive piston 74. Although, the end block 78 is separate from the valve block 42, the two components could be formed as a single piece and thus collectively are being referred to herein as a body 73. In a single piece body, the primary bore 43 and the piston bore 72 would comprise a common bore.

The first electrohydraulic valve 80 is mounted in a first control bore 82 which extends into the end block 78 and intersects the piston bore 72 at a right angle. The first electrohydraulic valve 80 has a first solenoid 84 which when electrically energized, produces movement of an armature 86 that selectively engages a first valve element 88. As will be described, operation of the armature 86 by the first solenoid 84 moves the first valve element 88 to proportionally control flow of fluid into the first and second piston control chambers 75 and 76. A feedback pin 90 has one end engaging a spring assembly 92 within the first valve element 88 and another end that engages the valve drive piston 74.

A pilot pressure passage 94 communicates with the first control bore 82 and conveys fluid at a regulated constant pilot pressure for operating the valve drive piston 74, as will be described. The end block 78 also has a pilot tank passage 93, which extends from tank return passage 59 in the valve block 42 into a portion of the first control bore 82. A first cross passage 96 couples that portion of the first control bore 82 to a second control bore 104. A branch passage 100 leads from the first piston control chamber 75 on the spool side of the valve drive piston 74 to the first control bore 82 and a second cross passage 102 forms a continuation of the branch passage 100 to the second control bore 104. An end of the second control bore 104 opens into the second piston control chamber 76 that is located on a remote side of the valve drive piston 74 from the valve spool 44.

With continuing reference to FIG. 2, a second electrohydraulic valve 81 has a second valve element 108 that slides within the second control bore 104 when a second solenoid 106 drives an armature 110 connected to the second valve element. The second electrohydraulic valve 81 is an on/off type valve having two states: energized and de-energized. When the second electrohydraulic valve 81 is de-energized, the second valve element 108 is positioned to connect the second cross passage 102 to the second piston control chamber 76. When the second electrohydraulic valve 81 is energized, the first cross passage 96, which communicates with the tank return passages 58 and 59, is connected to the second piston control chamber 76.

The first electrohydraulic valve 80 is a proportional device which meters the fluid from the pilot pressure passage 94 to control the position of the valve spool 44 and thus the rate at which fluid is supplied to the workports 46 and 48. The two states of the second electrohydraulic valve 81 determine the direction of movement of the valve drive piston 74 and of the valve spool 44. The movement direction of the valve spool 44 determines whether the piston rod 17 is extended from or retracted into the cylinder 16 of the first hydraulic actuator 11. Details of operation of the spool valve 40 by the two electrohydraulic valves 80 and 81 is described in U.S. Pat. No. 6,637,461.

Referring again to FIG. 1A, the first control valve section 31 has a first anti-cavitation valve 112 and a first workport pressure relief valve 114 are connected in parallel between the first workport 46 and the tank return passage 59 leading to the tank return conduit 28. A first workport pressure relief valve 114 releases any excessively high pressure that occurs at the first workport 46. An identical arrangement of a second anti-cavitation valve 116 and a second workport pressure relief valve 118 is connected to the second workport 48. The second control valve section 32 also has those arrangements of anti-cavitation and workport pressure relief valves coupled to its workports.

The control valve assembly 26 further includes a load sense circuit 120 comprising a conventional shuttle valve 121 within each of the five valve sections 31, 32, 33, 34 and 35. One inlet to each shuttle valve receives the load pressure from the spool valve 40 within the same valve section and another inlet is coupled by a passage 122 to the outlet 124 of a shuttle valve in an adjacent valve section. For example, an inlet of the shuttle valve 121 in the first valve section 31 is coupled by passage 122 to the outlet 124 of the shuttle valve 121 in the second valve section 32, which in turn has an inlet coupled by its passage 122 to the outlet 124 of the shuttle valve 121 in the third valve section 33 in FIG. 1B, and so on. Each shuttle valve 121 selects the greater of the two pressures at its inlets to apply to its outlet 124. The ultimate outlet 125 from the chain of shuttle valves 121, i.e. the outlet of the shuttle valve 121 in the first valve section 31, is connected in the first end section 36 to a load sense passage 95. The load sense passage 95 extends to the control input of the pump 21 and to the pressure compensation valve 64 in the valve sections 31-33. Each pressure compensation valve 64 responds to the pressure in the load sense passage 95 in a conventional manner that maintains a substantially constant drop across the metering orifice of the associated spool valve 40. A pressure relief valve 152 in the first end section 36 prevents the pressure within the load sense passage 95 from exceeding a maximum acceptable level.

Alternatively, electronic load sensing could be employed in which case the load sense circuit 120 and the pressure compensation valves 64 in each valve section 31-33 would be eliminated. Instead the pressure sensors 57 provide signals to the system controller 30 that indicate the load pressure acting on the respective hydraulic actuator. The software executed by the system controller 30 selects the highest supply pressure required by the sensors and regulates operation of the two electrohydraulic valves 80 and 81 that control each spool valve 40 to perform pressure compensation.

The two workports 46 and 48 of the first valve section 31 are connected by a pair of hoses 55 and 56 to a first remote valve assembly 127 that is proximate to the first hydraulic actuator 11. For example the first remote valve assembly 127 is physically mounted on the first hydraulic actuator. A pair of pressure sensors 57 provide signals to the system control that indicate the pressure at each cylinder chamber 19 and 20. The remote valve assembly 127 comprises a first regeneration shunt valve 126 and a first workport blocking valve 128. The electrically operated, proportional first regeneration shunt valve 126 is directly connected between the ports for the head chamber 19 and the rod chamber 20 of the first hydraulic actuator 11. The term "directly connected" as used herein means that the associated components are connected together by a conduit without any intervening element, such as a valve, an orifice or other device, which restricts or controls the flow of fluid beyond the inherent restriction of any conduit. In a de-energized state first regeneration shunt valve 126 blocks fluid flow between the ports for the two chambers of the first hydraulic actuator 11, whereas when energized an internal check valve allows fluid to flow only from the head chamber 19 to the rod chamber. Alternatively an external check valve connected in series with a bidirectional regeneration shunt valve could be used. By locating the regeneration shunt valve 126 in close proximity to the first hydraulic actuator 11 fluid energy loses in the regeneration mode are minimized.

The remote valve assembly 127 includes a first workport blocking valve 128 between the first port for the head chamber 19 and the hose 55 that is connected to the first workport 46. The first workport blocking valve 128 is electrically operated by the system controller 30 to open when fluid is to flow from the head chamber 19 in the first hydraulic actuator 11 to the first control valve section 31. Otherwise, the valve 128 is in the closed state in which an internal load check valve permits fluid to flow only from the first control valve section 31 to the head chamber 19. The first workport blocking valve 128 may be an electrohydraulic, proportional control valve similar to that described in U.S. Pat. No. 6,745,992, for example, the description of which is incorporated herein by reference. The workport blocking valve 128 operates in standard powered metering modes and also enables a hydraulic circuit with a spool type directional valve to operate in a regeneration mode, as will be described.

The load acting on the first hydraulic actuator 11 tends to retract the piston rod 17, thereby producing pressure within the head chamber 19. Under a heavy load condition, should the hose 55 connected to the first workport 46 burst, that pressure would be released allowing the load to drop precipitously if the workport blocking valve 128 is not present. Thus, in the closed state, the first workport blocking valve 128 prevents the load from dropping in the event of a hose failure. However, a pressure relief valve 129 within the first remote valve assembly 127 prevents pressure in the head chamber from reaching a dangerous level. Note that in the neutral, or centered, position the valve spool 44 that excessive pressure is conveyed to the tank return conduit 28.

The second valve section 32 is connected to the second hydraulic actuator 12 for a load that lends to extend the piston rod 17. The workports 46 and 48 of the second valve section 32 are connected to a similar remote valve assembly 130 adjacent the second hydraulic actuator 12. This second remote valve assembly includes a second regeneration shunt valve 132 and a check valve 133 between the chambers of the second hydraulic actuator 12. Check valve 133 ensures that fluid flows only in the direction from the rod chamber 20 to the head chamber 19 when the regeneration shunt valve 132 is open. Alternatively, the second regeneration shunt valve 132 and the check valve 133 could be replaced by a properly oriented valve like the first regeneration shunt valve 126. A second pressure relief valve 135 is directly connected between the chambers of the second hydraulic actuator 12 to relieve pressure in the rod chamber from reaching a dangerous level. A second workport blocking valve 134 also is provided. However, because the load acting on the second hydraulic actuator 12 tends to extend the piston rod 17 from the associated cylinder 16 thereby creating pressure within the rod chamber 20, the workport blocking valve 134 is connected to the rod chamber 20 to isolate that load pressure from hose 56 when the actuator is inactive.

The hydraulic circuitry associated with the workports of the third valve section 33 in FIG. 1B has a remote valve assembly 140 that contains only a third regeneration shunt valve 142 connected in series with a check valve 144 between the ports for the head and rod chambers of the third hydraulic actuator 13. A third workport blocking valve 146 is proximate to the third valve section 33 to control fluid flow between the spool valve 40 and the first workport 46. For example, the third workport blocking valve is mounted on the body 73 of the third valve section 33. Thus, the third workport blocking valve 146 is near the operator workstation and the system controller 30. Pressure sensors 57 are connected at the workports 46 and 48 of the third valve section 33, instead of being located at the remote valve assembly 140. This arrangement reduces the number of electrical wires that need to be run to the remote valve assembly 140 that is adjacent the third hydraulic actuator 13. However, placing the third workport blocking valve 146 at the third valve section 33 does not provide hose burst protection afforded in the other valve sections.

The fourth valve section 34 has a hydraulic circuit that differs from those in the other valve sections. The center position of the fourth valve section's spool valve 40 provides a path between the first workport 46 and the tank return passage 59 leading to the tank return conduit 28. This is accomplished by modifying the spool 44 in FIG. 2 so that the notch associated with the first workport passage 52 extends into the cavity 53 that communicates with the tank return passage 59. Therefore, in the centered position the hose 55 attached to the first workport 46 is connected to the tank 22. The pressure compensation valve 64 has been replace by a standard load check valve 115 that prevents fluid from flowing through the valve back into the supply passage 60. The fourth valve section 34 also has arrangement of an anti-cavitation valve 160 and a workport pressure relief valve 162 only for its second workport 48, and does not have a similar arrangement connected to the first workport 46.

The associated fourth remote valve assembly 170 comprises a fourth regeneration shunt valve 172 connected in series with a fourth check valve 174 between the ports for the head chamber 19 and the rod chamber 20 of the fourth hydraulic actuator 14. The fourth check valve 174 ensures that fluid flows only in the direction from the head chamber 19 to the rod chamber 20 when that regeneration shunt valve 172 is open. A fourth workport blocking valve 176 is provided between the port for the head chamber 19 and the hose 55 that is connected to the first workport 46 of the fourth valve section 34. A pressure relief valve 178 is connected in parallel with the fourth workport blocking valve 176 and opens when an excessively high pressure occurs in the head chamber 19. When the spool valve 40 in the fourth valve section 34 is in the centered position, that excessively high pressure is released through the first hose 55 and the connection through the spool valve to the tank return passage 59 leading to the tank return conduit 28.

The fifth valve section 35 controls the fifth hydraulic actuator 12 for a load that tends to extend its piston rod 17. That fifth valve section 35 is similar to the fourth valve section 34 except for lacking a neutral position tank return conduit connection and having an anti-cavitation valve 164 and a workport pressure relief valve 166 connected to the first workport 46. The associated fifth remote valve assembly 180 is identical to the second remote valve assembly 130 and has the same functionality. As a result, the identical components of the fifth valve section 35 and the fifth remote valve assembly 180 have been assigned the same reference numerals as those in the respective other portions of the control valve assembly 26.

In the exemplary control valve assembly 26, the second end section 37 merely contains terminations of the different passages 58/59, 60, 94, 95 and 122 which extend through the valve sections 31-35.

Referring again to FIG. 1A, the first end section 36 has ports to which the pump and tank conduits 24 and 28 connect to the control valve assembly 26. This first end section 36 also contains several pressure responsive valves for regulating pressures within various passages of the control valve assembly. Specifically, a first pressure relief valve 150 connects the supply conduit 24 to the tank return conduit for the tank 22 when the pressure within the supply conduit exceeds a predefined first threshold level. A second pressure relief valve 152 provides a path to the tank return conduit 28 when pressure within the load sense passage 95 exceeds a second threshold level. The first end section 36 provides a port by which the load sense passage 95 is coupled to the control input of the pump 21. A pressure regulator valve 154 connects the supply conduit 24 to the pilot pressure passages 94 within the five valve sections 31-35 and maintains those passages at a substantially constant pilot pressure for operating the valve drive pistons 74.

INDUSTRIAL APPLICABILITY

The control valve assembly 26 operates each hydraulic actuator 11-15 on the machine in similar ways. For example, operation of the first hydraulic actuator 11 is indicated by the machine operator moving the associated joystick 29 in a direction corresponding the desired operation. This sends a signal to the system controller 30, which responds by applying electrical currents to valves within the first valve section 31 and the first remote valve assembly 127 to produce motion of the associated piston rod 17. The fluid circuit for the first hydraulic actuator 11 as well, as the other actuators 12-14, can operate in different metering modes, including powered extension, powered retraction, unpowered self regeneration, and powered regeneration modes, as selected by the controller in response to the joystick signal and existing conditions. In addition to functioning in a discrete metering mode, a hydraulic actuator's circuit can operate in a combination of metering modes to provide smooth, continuous control of the related actuator.

In the powered extension mode for the first hydraulic actuator 11, the system controller 30 activates the first and second electrohydraulic valves 80 and 81 in the first valve section 31 to apply pressurized fluid from the pilot pressure passage 94 to the second piston control chamber 76 in FIG. 2, while releasing pressure in the first piston control chamber 75 to the tank 22. This exerts a force on the valve drive piston 74 that moves the valve spool 44 into a position in which pressurized fluid from the supply conduit 24 is applied to the first workport 46 and the second workport 48 is connected to the tank return conduit 28. Specifically, the valve spool 44 is positioned so that fluid flows from the supply conduit 24 and the supply passage 60 through the pressure compensation valve 64, the bridge passage 68 and the first workport passage 52 to the first workport 46. The spool valve position also provides another path from the second workport 48 via the second workport passage 54 and the tank passage 58 to the tank return conduit 28. While this is occurring, the workport blocking valve 128 within the first remote valve assembly 127 in FIG. 1 also is energized to open. This configuration applies the pressurized fluid from the first workport 46 to the head chamber 19 of the first cylinder 16 while draining fluid from the rod chamber 20, thereby extending the piston rod 17 farther out of the cylinder 16.

When the machine operator commands a retraction of the cylinder rod 17 into the cylinder 16 of the first hydraulic actuator 11, the hydraulic system 10 has the option of utilizing a powered retraction mode or an unpowered self regeneration retraction mode. In the powered retraction mode, the system controller 30 activates the first and second electrohydraulic valves 80 and 81 to apply pressurized fluid to the first piston control chamber 75 so as to impel the valve drive piston 74 to position the valve spool 44 so that fluid from the supply conduit 24 is conveyed to the second workport 48 of the first valve section 31, while the first workport 46 is coupled via tank return passage 59 to the tank return conduit 28. In this powered retraction mode, the first workport blocking valve 128 also is energized into the open state. In this configuration, pressurized fluid is applied to the rod chamber 20 while fluid in the head chamber is released to the tank 22. This results in a retraction of the piston rod 17 into the cylinder 16.

As noted previously, a load operating on the machine components attached to the first hydraulic actuator 11 exerts a force, such as due to gravity, which tends to retract the piston rod 17 into the cylinder 16. Thus when retraction of the piston rod is desired, that externally exerted force can be utilized to either replace or augment a force due to application of pressurized fluid from the supply conduit to the cylinder.

The determination to taken advantage of this external force and use the unpowered self regeneration retraction mode, as opposed to a powered mode to retract the first hydraulic actuator 11, is made by the system controller 30 in response to pressure measurements from the supply and return conduit sensors 25, 27 and sensors 57 connected to the cylinder chambers 19 and 20. When these pressure measurements indicate that fluid will flow into the rod chamber 20, the system controller 30 opens both the first workport blocking valve 128 and the regeneration shunt valve 126 in the first remote valve assembly 127. This enables the fluid in the head chamber 19 to flow directly into the rod chamber 20, thereby enabling the piston 18 to move in a direction which retracts the piston rod 17. Fluid from the supply conduit 24 is not required for this, motion, thus this is an unpowered mode.

However, the head chamber 19 has a greater volume than the rod chamber 20 due to the presence of a portion of the piston rod 17 in that latter chamber. As a result, the excess fluid exiting the head chamber 19 must be exhausted through the directional spool valve 40 which in the centered neutral position connects the first workport 46 to the return passages 58 and 59 and return conduit 28. Thus the first workport blocking valve 128 is controlled to meter that excess fluid through the directional spool valve 40 to the tank 22.

The remote valve assembly 127 can be used with a spool valve which does not provide a drain path in the centered position. However, that hydraulic circuit operates differently in the regeneration operating mode than the circuit just described. Now the system controller 30 opens only the regeneration shunt valve 126 in the first remote valve assembly 127 and maintains the first workport blocking valve 128 closed. The directional spool valve 40 is operated to create one flow path between the second workport 48 and the tank return conduit 28 leading to the tank 22, and another path between the first workport 46 and the supply conduit 24 through pressure compensation valve 64. Therefore, the amount of fluid exiting the head chamber 19 that is not needed to fill the and rod chamber 20, flows into the second workport 48 and through the spool valve 40 and the tank return conduit 28 into the tank 22. Although pressurized fluid from the supply conduit 24 is applied to the first workport 46, the closed first workport blocking valve 128 prevents that the supply fluid from reaching the cylinder 16.

Similar operating modes are utilized to operate the second hydraulic actuator 12 that is connected to the second remote valve assembly 130 and the second valve section 32. However the load acting on this hydraulic actuator tends to extend its piston rod 17 from the cylinder15. As a consequence, the second workport blocking valve 134 is connected to the hose 56 running from the second workport 48 to the rod chamber 20. The powered extension and retraction modes operate in the same manner as those described with respect to the first valve section 31. However, a powered self regeneration mode may be used to extent the piston rod by taking advantage of the force from the load when pressure in the rod chamber 20 exceeds the head chamber pressure. In this mode, the regeneration shunt valve 132 is opened to route fluid directly from the rod chamber 20 to the head chamber 19 of cylinder 16. Because the rod chamber 20 is smaller than the head chamber 19, additional fluid is required to fill the latter chamber and that fluid comes from the supply conduit 24. Therefore, in the powered self regeneration extension mode, the directional spool valve 40 in second valve section 32 is placed in the position in which the first workport 46 is connected via supply passage 60 to the supply conduit 24. While this is occurring, the second workport blocking valve 134 is held closed to prevent fluid in the second remote valve assembly 130 from flowing through the directional spool valve 40 to the tank return conduit 28. This mode is referred to as a powered self regeneration mode as it consumes some quantity of fluid from the supply conduit 24.

The third valve section 33 operates in a similar manner as described with respect to the first valve section 31 because the load force tends to retract the piston rod. However, the third valve section 33 differs structurally in that the third workport blocking valve 146 is proximate, e.g. is mounted on, the third valve section 33, instead of being located at the third remote valve assembly 140. It should be noted that placing the third workport blocking valve 146 near the third valve section 33 does not provide hose burst protection afforded by located that valve at the actuator end of the hose.

Another difference with respect to the third valve section 33 is that its spool valve 40 in the centered position does not provide a path from the first workport 46 to the tank return conduit 28. Now in order to exhaust the excess fluid exiting the head chamber 19 in the unpowered self regeneration retraction mode, the spool valve 40 must be activated, in addition to the third workport blocking valve 146. Activation of the spool valve 40 is accomplished by energizing the first and second electrohydraulic valves 80 and 81 to apply pressurized fluid to the second piston control chamber 76. That action moves the valve drive piston 74 leftward a small amount in FIG. 2 to position the valve spool 44 so that a flow path is created between the first workport 46 and the tank return passage 59 via the second spool notch 63 and cavity 53. The valve spool 44 moves such as small distance that the first spool notch 61 does not yet open into the supply path cavity 65 coupled to the outlet of the pressure compensation valve 64. Therefore, the excess fluid from the head chamber 19 of the third hydraulic actuator 13 drains to the tank 22 without pressurized fluid from the supply conduit 24 being applied to that hydraulic actuator. In this manner, a regeneration operating mode can be utilized on a hydraulic circuit that has a spool valve as the directional metering valve.

The load applied to the fourth hydraulic actuator 14 exerts a force thereon that tends to retract the piston rod 17. Therefore, the fourth valve section 34 also can operate in the powered extension, powered retraction, and regeneration metering modes in the same manner as described previously with respect to the first hydraulic actuator 11. However, the hydraulic circuit for the fourth hydraulic actuator 14 functions differently in the deactivated state in which its spool valve 40 is in centered position as illustrated. This spool position closes the second workport 48, while providing between the first workport 46 and the tank return passage 59 leading to the tank return conduit 28, thereby providing a path from the first workport hose 55 to the tank 22. However at this time, the closed states of the valves 172, 176 and 178 in the fourth remote valve assembly 170 block fluid flow to and from the head chamber of the fourth hydraulic actuator 14. In the event that the pressure in the head chamber 19 exceeds the threshold setting of pressure relief valve 178 while the spool valve 40 in the fourth valve section 34 is centered, that pressure relief valve opens releasing fluid through the spool valve into the return passages and conduits 59/60 and 28 to the tank 22.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. For example, a particular valve assembly may have different numbers of valve sections, all of which are identical or different combinations of the five types 31-35 that are disclosed herein. A skilled artisan also can develop other valve sections embodying the concepts of the present invention. Accordingly, the scope of the invention should be determined from the following claims and not limited by the above disclosure.

What is claimed is:

1. A hydraulic circuit for controlling flow of fluid between a hydraulic actuator, that has a first port and a second port, and each of a supply conduit and a tank return conduit, said hydraulic circuit comprising:

a spool valve having an inlet connected to the supply conduit, an outlet connected to the tank return conduit, a first workport and a second workport, wherein the spool valve selectively directs fluid from the inlet to one of the first and second workports and selectively directs fluid from another of the first and second workports to the outlet;

a workport blocking valve connecting connected between the first workport to the first port of the hydraulic actuator; and a regeneration shunt valve connected to the hydraulic actuator and through which fluid flows between the first port and the second port, wherein the regeneration shunt valve has a first position in which fluid flow between the first port and the second port in both directions is blocked and has a second position that conveys fluid between the first port and the second port regardless of the state of the workport blocking valve.

2. The hydraulic circuit as recited in claim 1 further comprising a check valve in series with the regeneration shunt valve between the first port and the second port.

3. The hydraulic circuit as recited in claim 1 further comprising a mechanism which permits fluid to flow in only one direction through the regeneration shunt valve between the first port and the second port.

4. The hydraulic circuit as recited in claim 1 wherein the workport blocking valve and the regeneration shunt valve are located remotely from the spool valve and proximate to the hydraulic actuator.

5. The hydraulic circuit as recited in claim 1 wherein the regeneration shunt valve is located remotely from the spool valve and proximate to the hydraulic actuator; and the workport blocking valve is located proximate to the spool valve.

6. The hydraulic circuit as recited in claim 1 wherein the workport blocking valve is a pilot-operated valve.

7. The hydraulic circuit as recited in claim 1 further comprising a pressure relief valve connected between the first port and a second port of the hydraulic actuator, and opening when pressure at the first port exceeds a predefined level.

8. The hydraulic circuit as recited in claim 1 further comprising an anti-cavitation valve connected between the first workport and the tank return conduit, and opening in response to cavitation in the hydraulic actuator.

9. The hydraulic circuit as recited in claim 1 further comprising:

a first pressure relief valve connected between the first workport and the tank return conduit, and opening when pressure at the first workport exceeds a predefined level;

a first anti-cavitation valve connected between the first workport and the tank return conduit, and opening in response to cavitation in the hydraulic actuator;

a second pressure relief valve connected between the second workport and the tank return conduit, and opening when pressure at the second workport exceeds a predefined level; and a second anti-cavitation valve connected between the second workport and the tank return conduit, and opening in response to cavitation in the hydraulic actuator.

10. The hydraulic circuit as recited in claim 1 further comprising a pressure compensation valve connected to the spool valve and maintaining a substantially constant pressure drop between the inlet and a selected one of the first and second workports.

11. The hydraulic circuit as recited in claim 10 further comprising a load sense circuit connected to the spool valve and providing a signal indicating a pressure level desired in the supply conduit; and the load sense circuit connected to operably control the pressure compensation valve.

12. The hydraulic circuit as recited in claim 1 wherein the spool valve has a state in which the first workport is connected to the outlet and in which fluid is blocked from flowing through the second workport; and further comprising a pressure relief valve connected in parallel with the workport blocking valve and opening when pressure at the first port of the hydraulic actuator exceeds a predefined level.

13. The hydraulic circuit as recited in claim 1 wherein the spool valve connects the first workport to the tank return conduit before making a simultaneous connection of the second workport to the supply conduit.

14. The hydraulic circuit as recited in claim 1 further comprising a check valve operably coupled to limit fluid flow through the regeneration shunt valve, in the second position, to a direction only from the first port and the second port.

15. A hydraulic circuit for controlling flow of fluid between a first port and a second port of a hydraulic actuator and each of a supply conduit conveying pressurized fluid and a tank return conduit, said hydraulic circuit comprising:

a spool valve having an inlet connected to the supply conduit, an outlet connected to the tank return conduit, a first workport and a second workport, and having a first position in which fluid flows from the inlet through a metering orifice to the first workport and from the second workport to the outlet, and having a second position in which fluid flows from the inlet through a metering orifice to the second workport and from the first workport to the outlet;

a pressure compensation valve connected to the spool valve and maintaining a substantially constant pressure drop across the metering orifice;

a workport blocking valve connecting the first workport to the first port of the hydraulic actuator, and controlling fluid flow there between; and a regeneration shunt valve connected to the hydraulic actuator and through which fluid flows between the first port and the second port, wherein the regeneration shunt valve has a first state in which fluid flow between the first port and the second port in both directions is blocked and a second state that conveys fluid between the first port and the second port regardless of the state of the workport blocking valve.

16. The hydraulic circuit as recited in claim 15 wherein the spool valve has a third position in which fluid is blocked from flowing through the first workport and the second workport.

17. The hydraulic circuit as recited in claim 15 wherein the spool valve has a third position in which the first workport is connected to the outlet and in which fluid is blocked from flowing through the second workport; and further comprising a pressure relief valve connected in parallel with the workport blocking valve and opening when pressure at the first port of the hydraulic actuator exceeds a predefined level.

18. The hydraulic circuit as recited in claim 15 further comprising a mechanism which permits fluid to flow in only one direction through the regeneration shunt valve between the first port and the second port.

19. The hydraulic circuit as recited in claim 15 wherein the workport blocking valve and the regeneration shunt valve are located remotely from the spool valve and proximate to the hydraulic actuator.

20. The hydraulic circuit as recited in claim 15 wherein the regeneration shunt valve is located remotely from the spool valve and proximate to the hydraulic actuator; and the workport blocking valve is located proximate to the spool valve.

21. The hydraulic circuit as recited in claim 15 wherein the workport blocking valve is a pilot-operated valve.

22. The hydraulic circuit as recited in claim 15 further comprising a pressure relief valve connected between the first port and a second port of the hydraulic actuator, and opening when pressure at the first port exceeds a predefined level.

23. The hydraulic circuit as recited in claim 15 further comprising an anti-cavitation valve connected between the first workport and the tank return conduit, and opening in response to cavitation in the hydraulic actuator.

24. The hydraulic circuit as recited in claim 15 further comprising:

a first pressure relief valve connected between the first workport and the tank return conduit, and opening when pressure at the first workport exceeds a predefined level;

a first anti-cavitation valve connected between the first workport and the tank return conduit, and opening in response to cavitation in the hydraulic actuator;

a second pressure relief valve connected between the second workport and the tank return conduit, and opening when pressure at the second workport exceeds a predefined level; and a second anti-cavitation valve connected between the second workport and the tank return conduit, and opening in response to cavitation in the hydraulic actuator.

25. The hydraulic circuit as recited in claim 15 further comprising a load sense circuit connected to the spool valve and providing a signal indicating a pressure level required in the supply conduit; and controlling the pressure compensation valve.

26. The hydraulic circuit as recited in claim 15 wherein the spool valve connects the first workport to the tank return conduit before making a simultaneous connection of the second workport to the supply conduit.

27. A hydraulic circuit for controlling flow of fluid between a hydraulic actuator, that has a first port and a second port, and each of a supply conduit and a tank return conduit, said hydraulic circuit comprising:

a spool valve having an inlet connected to the supply conduit, an outlet connected to the tank return conduit, a first workport and a second workport, wherein the spool valve selectively directs fluid from the inlet to one of the first and second workports and selectively directs fluid from another of the first and second workports to the outlet;

a workport blocking valve connected between the first workport to the first port of the hydraulic actuator;

a regeneration shunt valve connected to the hydraulic actuator and through which fluid flows between the first port and the second port; and an anti-cavitation valve connected between the first workport and the tank return conduit, and opening in response to cavitation in the hydraulic actuator.

* * * * *